US006108980A

United States Patent [19]

Braun

[11] Patent Number: 6,108,980

[45] Date of Patent: Aug. 29, 2000

[54] BUILDING ELEMENT

[76] Inventor: Dieter Braun, Schrenekweg 1, 85658 Egmating, Germany

[21] Appl. No.: 09/022,002

[22] Filed: Feb. 11, 1998

Related U.S. Application Data

[63] Continuation-in-part of application No. 08/454,158, Jun. 15, 1995, abandoned.

[51] Int. Cl.[7] ..... E04H 15/20

[52] U.S. Cl. ..... 52/2.16; 52/2.22; 52/2.23; 135/136

[58] Field of Search ..... 52/2.16, 2.18, 52/2.22, 2.23, 6; 135/88.13, 136

[56] References Cited

FOREIGN PATENT DOCUMENTS

| | | | |
|---|---|---|---|
| 0678154 | 8/1979 | U.S.S.R. | 52/2.23 |
| 001513115 | 10/1989 | U.S.S.R. | 52/2.23 |
| 1046632 | 10/1966 | United Kingdom | 52/2.18 |

*Primary Examiner*—Carl D. Friedman
*Assistant Examiner*—Yvonne M. Horton
*Attorney, Agent, or Firm*—Dennison, Scheiner, Schultz & Wakeman

[57] ABSTRACT

The invention relates to a building element for lightweight constructions, such as halls and airship structures, having first wall segments mutually spaced, hollow and subjected to overpressure and extending over the whole thickness of the wall, with an intermediate space being formed between the wall segments and designed at least in parts as a negative pressure chamber.

15 Claims, 7 Drawing Sheets

Figure 1A:
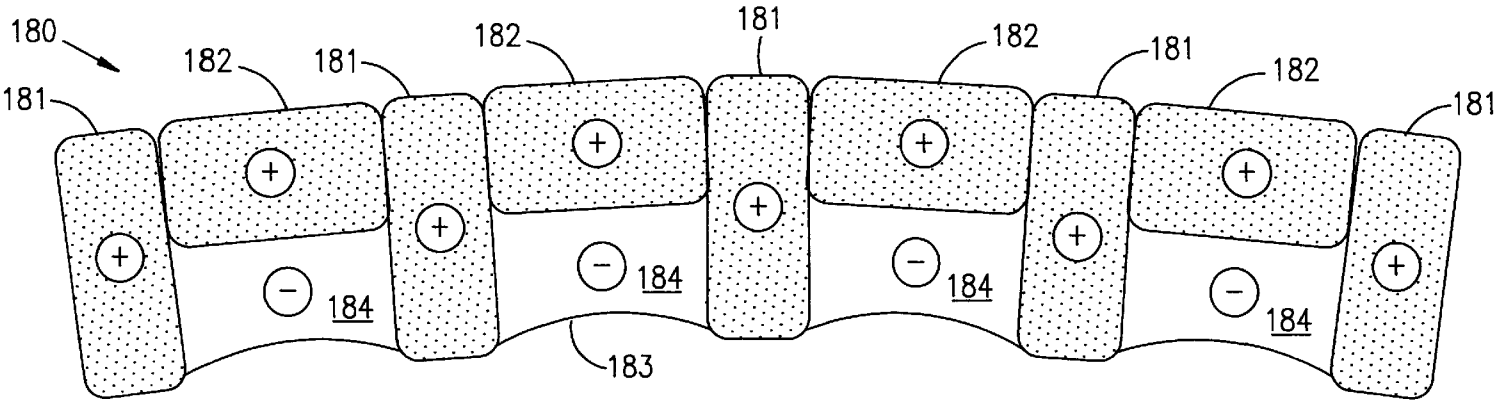

FIG. 2
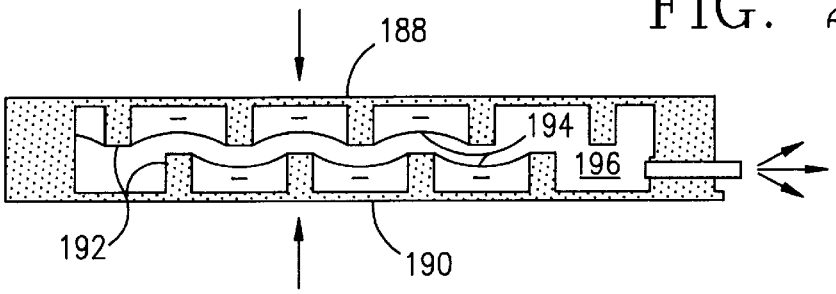
FIG. 3
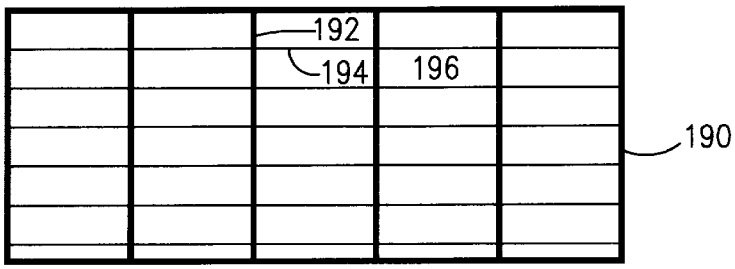
FIG. 4
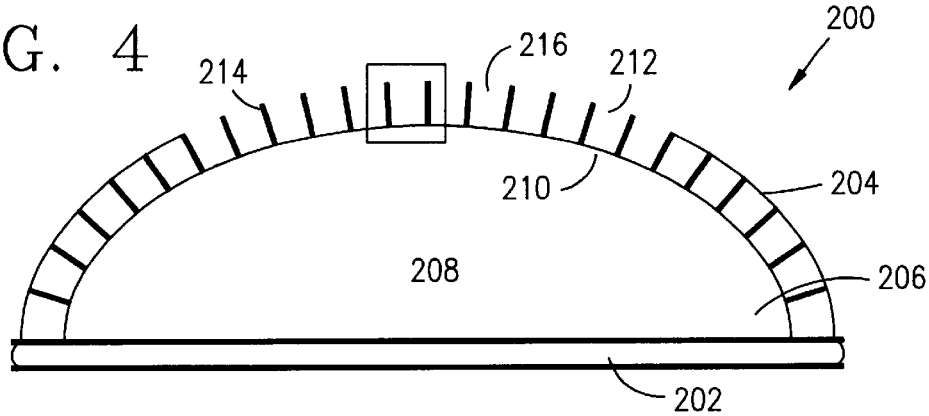
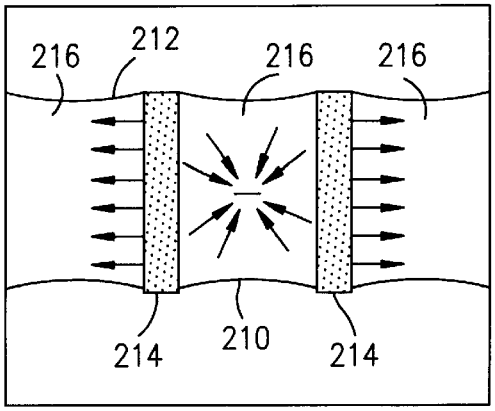
FIG. 5

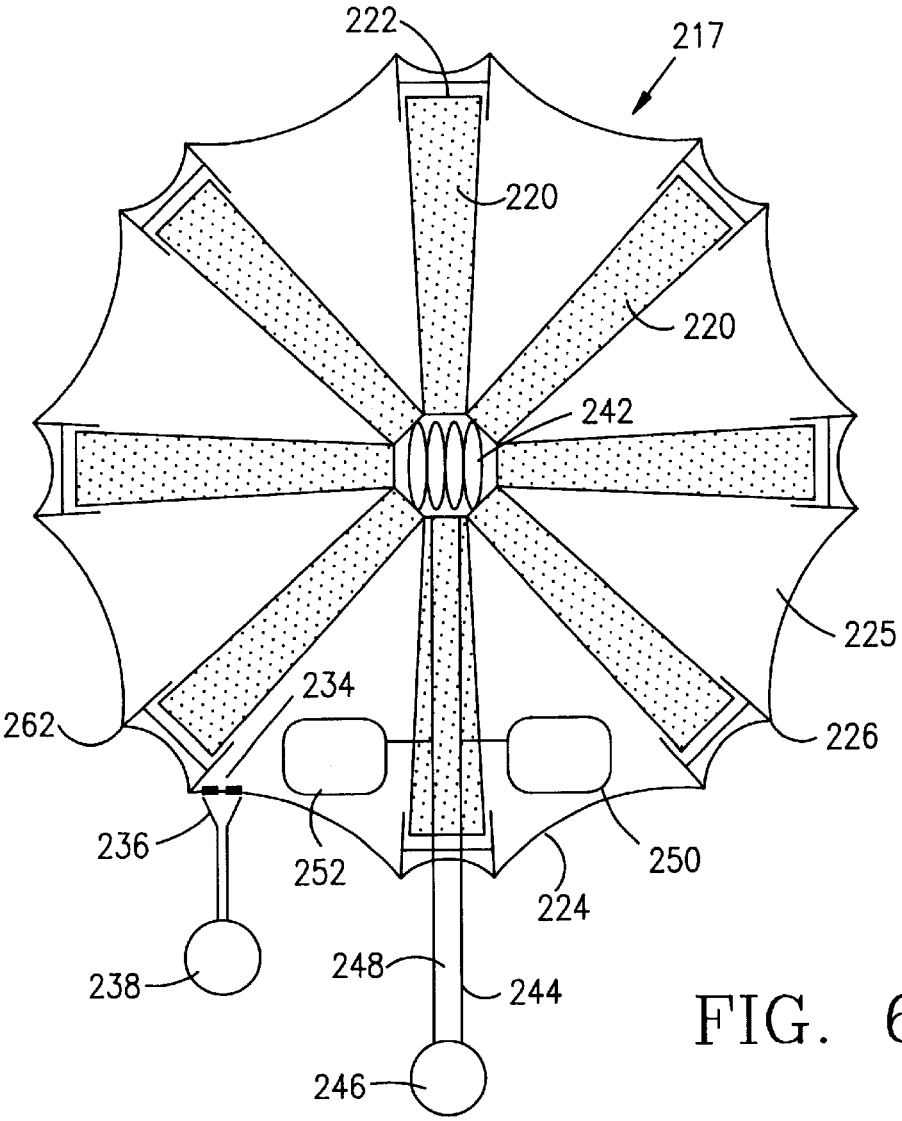
FIG. 6
FIG. 7
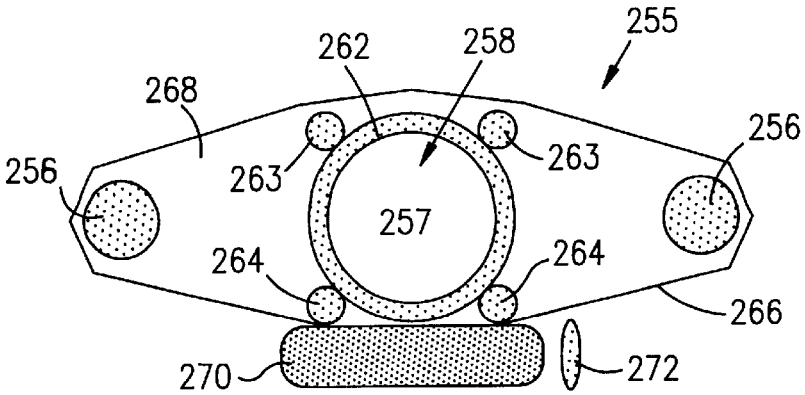

FIG. 8
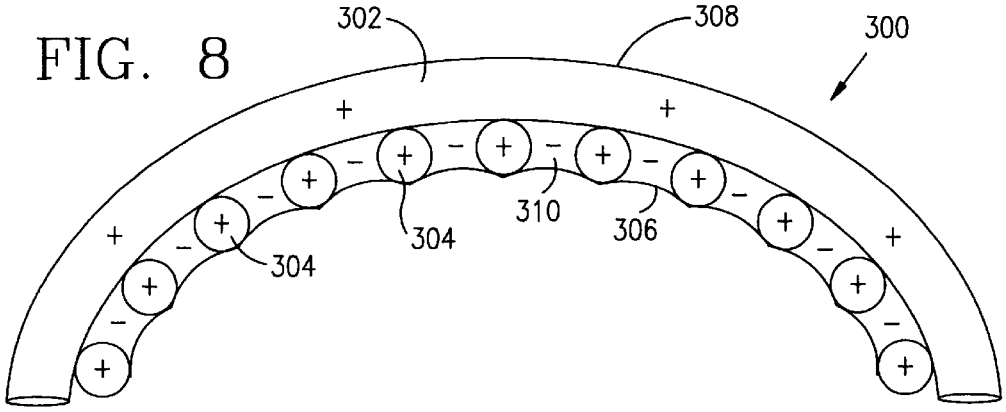
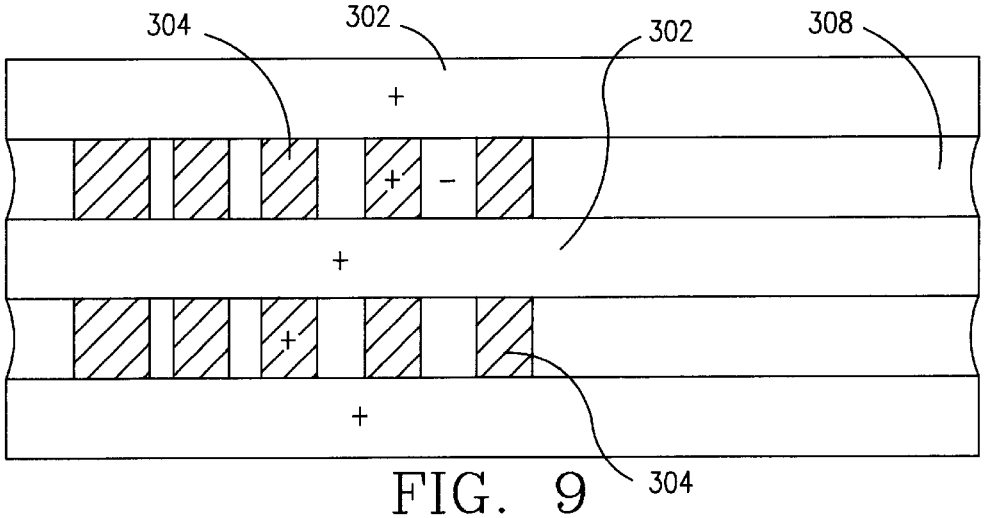
FIG. 9
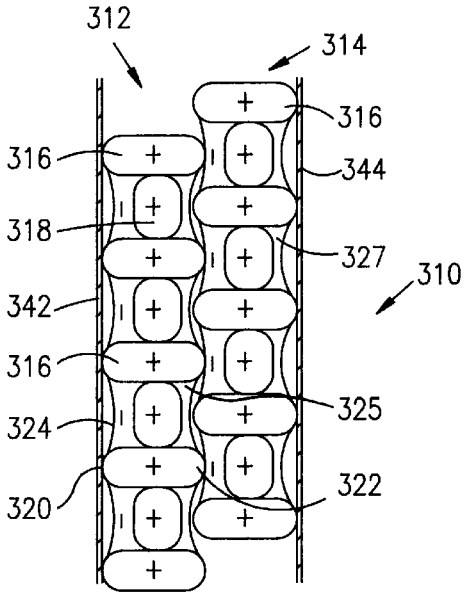
FIG. 10
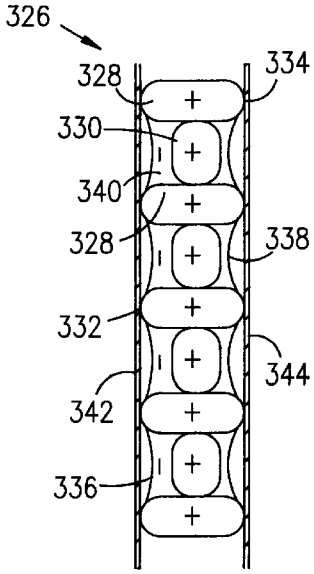
FIG. 11

FIG. 20
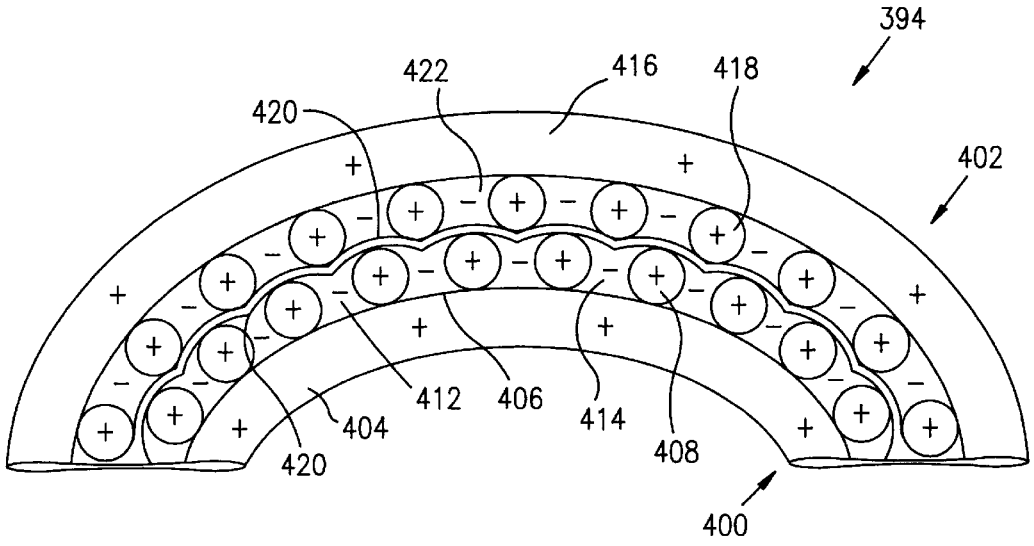
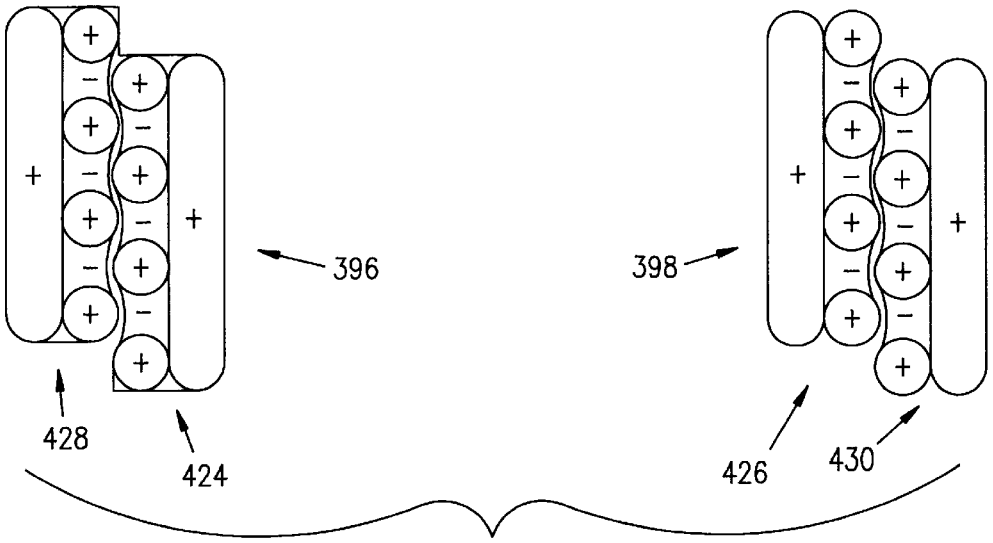
FIG. 21

BUILDING ELEMENT

This application is a Continuation-in-part of application Ser. No. 08/454,158 filed Jun. 15, 1995, now abandoned.

DESCRIPTION

Building Element

The invention relates to a building element for lightweight constructions such as halls and airship structures having first wall segments mutually spaced, hollow and subjected to over-pressure and extending over the whole thickness of the wall, with an intermediate space being formed between the wall segments and designed at least in parts as a negative pressure chamber. The invention relates specifically to a wall or ceiling element for a construction.

When designing building elements for lightweight constructions, the problem that crops up is that these are lightweight but have insufficient stability. The lack of stability is in such cases achieved using lattice constructions of metal, plastic or carbon fiber. This not only makes the building elements heavier, but also more complicated in design, hence complicating their manufacture too.

In the treatise "Pneumatisch stabilisierte Membrantragwerke" by Dr. Ing. Gernot Minke in "Deutsche Bauzeitschrift" No. 7, Jul. 18, 1972, pp. 1283–1299, the design and the formal possibilities for design of pneumatically stabilized diaphragm structures are presented. If negative pressure systems are used for the construction of pneumatically stabilized structures, the drawback is that these structures always have inward-sagging wall areas. The consequence is that in negative pressure systems snow and water can accumulate very easily in the roof areas and instabilities can occur under aerodynamic stresses from wind. In addition, negative pressure systems generally required high supports at the edges or in the middle. This therefore entails relatively material-intensive secondary structures.

The object underlying the present invention is to develop a building element that is light-weight but has a high stability and thermal insulation effect.

The problem is solved in accordance with the invention is an arrangement of the type described at the outset in that in each case a part of the intermediate spaces between the first wall segments and staring at a wall outer side is filled by hollow second wall segments that are subjected to over-pressure and that form with a wall arranged between the wall inside ends of the first wall segments and the walls of the first wall sections the negative pressure chambers, with a vacuum being adjustable in the negative pressure chambers to generate a lift.

The problem is resolved in part by a light-weight design wall or roof structure for a construction such as a ball, including a ceiling and side walls, whereby at least some sections of the ceiling and/or side walls feature first and second wall elements filled with pressurized air, the first being exterior wall elements, the second being interior wall elements, the first and second wall elements being joined in such, whereby between the first and second wall elements a recess is formed which is a closed vacuum chamber.

In addition a solution provides a lightweight wall or roof structure for a construction including:

an inner, pressure-resistant first wall element arrangement characterized by a surface alignment which is identical to or similar to the surface alignment of the wall or roof, first projections which extend from the first wall element arrangement and are directed outwards a flexible first element extending along the outer ends of the projections, an outer, pressure-resistant wall element arrangement characterized by a surface alignment identical or similar to the surface alignment of the wall or of the roof, second projections extending inwards which start from the second wall element arrangement, a flexible second element extending along the outer ends of the second projections, the first wall element arrangement together with the first projections and the first flexible element are the inner half of the wall or roof structure, whereby the first projections of the inner half are arranged staggered in relation to the second projections of the outer half.

An additional preferred arrangement includes:

A building element for lightweight wall constructions of self-supporting structures, said building element comprising:

a plurality of hollow first wall segments having a substantially rectangular cross-section extending over the thickness of a wall, said first wall segments being separated by intermediate spaces corresponding to the wall thickness;

a plurality of hollow second wall segments having a substantially rectangular cross-section;

said second wall segments filling a first portion of the intermediate spaces and forming a connection between first wall segments, and a second portion of the intermediate spaces being closed to form hollow third wall segments;

said first and said second wall segments being subjected to over-pressure, said third wall segments being subject to a vacuum.

Thanks to this chamber design, a building element usable for many applications for lightweight construction is available. The chambers subjected to over-pressure give the chamber arrangement high stability. Thanks to the insulating effect of the evacuated chamber elements, the arrangement can also be used for thermal insulation. By varying the chamber cross-sections, the shape of the building element can be varied to suit the application. As a result, the building element can therefore be designed for a dome-shaped or barrel-shaped roof structure. Here the cross-sections of the wall segments are matched in modular form to the wall or roof shape and designed rectangular or trapezoidal in shape, for example. The wall segments subjected to over-pressure are firmly connected to one another, such that a self-supporting structure is obtained that is suitable for large building element units. With a low pressure in the recesses, good thermal insulation properties are already achieved. In addition to the high heat transmission resistance achieved thanks to the thermal insulation, light-permeable materials can be used for the film. The inner areas of the wall segments are, for example, interconnected by openings, such that in all wall segments the over-pressure can be achieved by inflation with air or with a gas such as helium.

The chamber arrangement can be used to advantage as a building element for a hall structure. In particular, it is ideal for use as a hall roof structure, since complex support structures for the hall roof can be dispensed with here.

In a different and favorable device, the chamber arrangement is designed such that it has walls of which at least one contains two identically designed halves arranged on the inside and on the outside and having first hollow wall segments subjected to over-pressure and arranged at a distance from one another, such that in each case the intermediate spaces beginning from one wall outer side and between the first wall segments are partially filled by further second hollow wall segments subjected to over-pressure and connected to the first wall segments, such that on the sides of the first wall segments facing away from the wall outer sides films are pressed on under the negative pressure prevailing in the wall segment-free intermediate spaces, and such that the first wall segments of the two halves are arranged offset in relation to one another by half the spacing of the wall segments.

This device results in a very good thermal insulation plus high strength of the building element. The wall segments of one half each can also be interconnected by openings to permit simultaneous generation of over-pressure in all wall segments. The thermal insulation can be improved the greater the negative pressure in the intermediate spaces between the first wall segments.

In vacuum/negative pressure chamber designs of this type, a housing with a certain stability is generated. As a result, heavy and thermally conducting support elements for the supporting framework can largely be dispensed with in a roof structure.

In a preferred device, it is provided that the chamber arrangement is a building element for a hall or hall structure. The hall structure is here designed such that the hall surrounds an interior area having a higher pressure than the surroundings, such that the hall has a hall roof structure designed as an at least double-walled skin, such that the skin comprises an inner skin and an outer skin kept apart by gas-filled supporting segments, and such that a vacuum is generatable in the intermediate space between the supporting segments.

Thanks to the especially light yet sturdy design of the chamber arrangement, the latter can be used as a hall roof structure. This enables the roof structure to be stabilized by an over-pressure generated inside the hall. The stability of the arrangement is further increased by the gas-filled supporting segments. Thanks to the evacuated intermediate spaces between the supporting segments a high insulation effect is attained in addition. Complicated, heavy and expensive supporting frameworks can therefore be dispensed with.

The hall structure is preferably designed such that when the interior of the hall structure is heated this structure undergoes lift, to the extend that the hall structure floats. Thanks to the good insulation properties of the hall roof structure, the interior of the hall has good heat insulation compared with the surroundings. If there is no air exchange with the environment, the air trapped in the interior can be heated up by sunlight so much that the hall structure lifts like a hot air balloon. This lift can be reinforced by the vacuum in the chambers of the roof structure. This enables the hall structure to be transported easily using load-carrying helicopters or airships.

In a further advantageous chamber arrangement, in particular for a balloon or an airship, it is provided that tubular gas-filled supporting segments radiate outwards from a central chamber, that the supporting segments are surrounding peripherally by a skin, with a balloon interior enclosed by the skin being adjustable in pressure. The pressure in the balloon interior can be adjusted in this arrangement, for example with a valve attached to the skin and with a vacuum pump, such that a vacuum is generated there. The tubular, gas-filled supporting segments are almost ideally insulated by this vacuum. The incidence of sunlight can greatly heat up the gas, such as helium. The increasing pressure stabilizes the chamber structure, so that the vacuum in the balloon interior can be increased.

It is favorable for the skin to have a valve interacting with a vacuum pump. As a result, the pressure inside the balloon interior can be set as required. By evacuating the interior and varying the vacuum, the lift of the chamber arrangement such as a balloon or airship can be controlled.

The supporting segments advantageously have an outer skin comprising high strength, heat-absorbing and heat-resistant film. Since the gas is greatly heated by the incidence of sunlight and can therefore develop a very high pressure, the outer skins of the supporting segments must comprise high-strength and heat-resistance films. The heat-absorbing properties of the outer skin have the advantage that the heat yield from the incident sunlight is improved.

The supporting segments advantageously have at their ends a heat insulator for holding the skin. In view of the high temperatures of the gas enclosed inside the supporting elements, the outer skin must for safety reasons and for thermal insulation be arranged insulated from the supporting segments.

In a further preferred arrangement, the chamber system has a heat engine comprising an evaporator, an energy converter unit plus piping. The evaporator is here arranged in a central chamber. The gas heated inside the supporting segments by sunlight can be conveyed by recirculating elements such as pumps through connections between the supporting segments and the inner chamber into the latter. In the central chamber, the inner energy of the gas is converted by the evaporator and dissipated in the form of steam. The steam has to be dissipated because the excellent insulation properties of the vacuum would cause the temperature of the gas present in the supporting segments to rise sufficiently to cause the destruction of the supporting segments.

The chamber arrangement can have an energy accumulator and a water accumulator arranged in an evacuated interior space. The energy accumulator can be designed, for example, to take steam. The almost ideal thermal insulation in the evacuated interior keeps the steam stored therefor long periods. The stored steam can be supplied later on to the energy converter unit and converted there into electrical energy.

In a particularly preferred embodiment, the chamber arrangement is designed as an airship, with the chamber arrangement having a spherical, ellipsoid or disk shape and having on the outer skin a car containing a drive unit. This makes the arrangement suitable for transporting heavy loads and also maneuverable.

Further details, advantages and features of the invention are shown not only in the claims and in the features therein, singly and/or in combination, but also in the following description of an embodiment shown in the drawing.

Figure 1B:
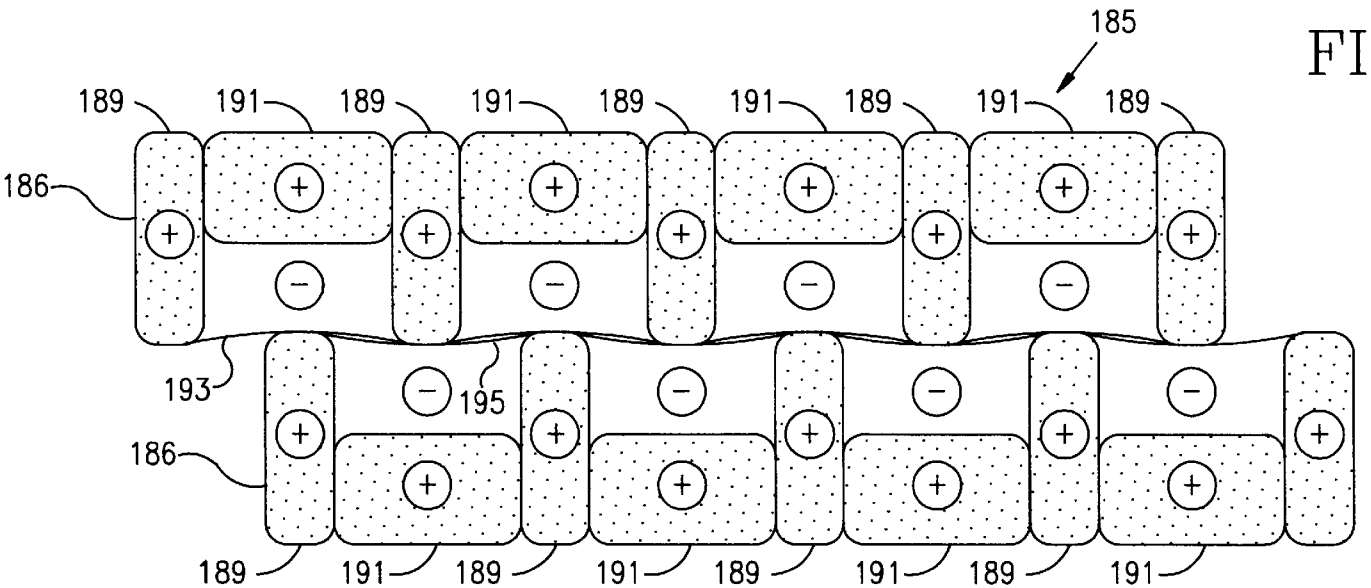
Figure 12:
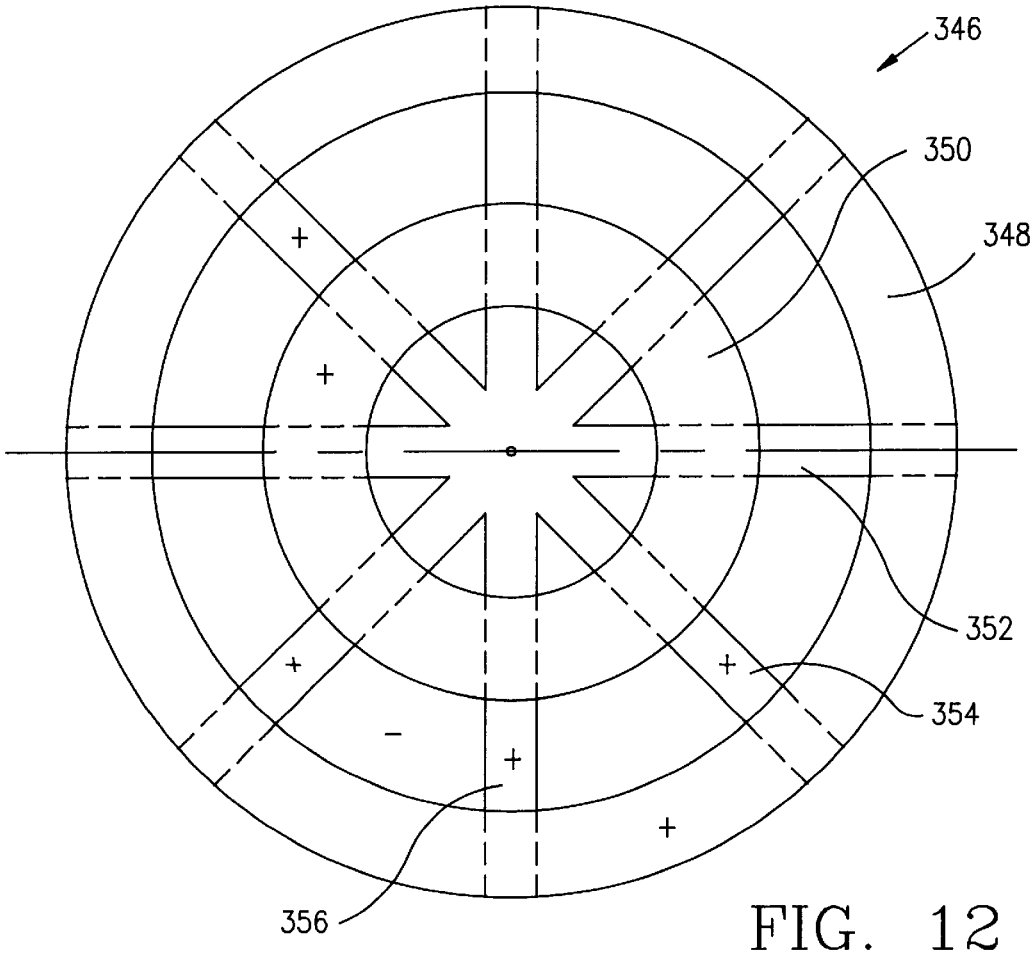
Figure 13:
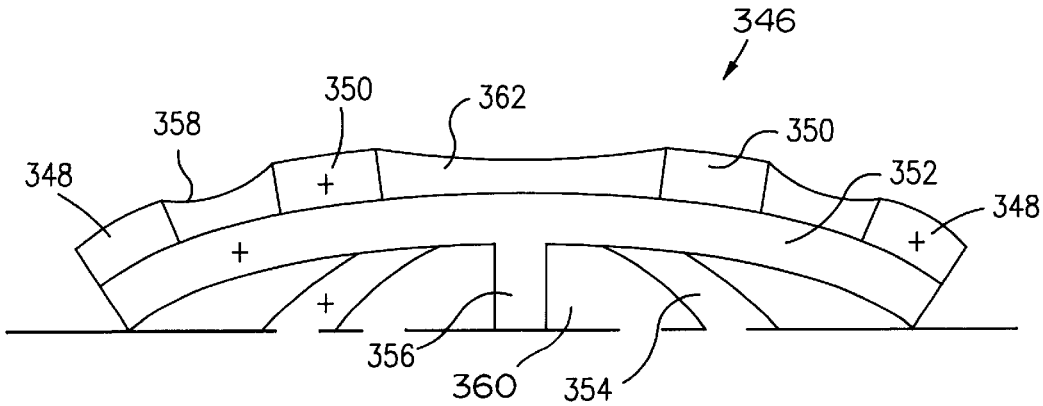
Figure 14:
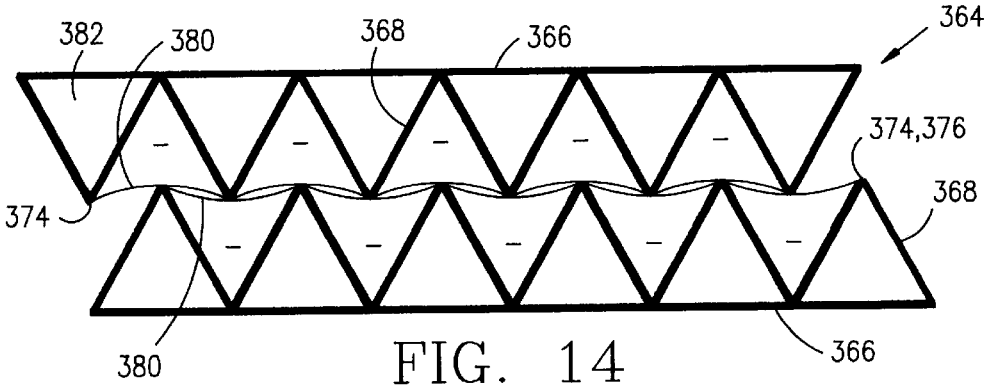
Figure 15:
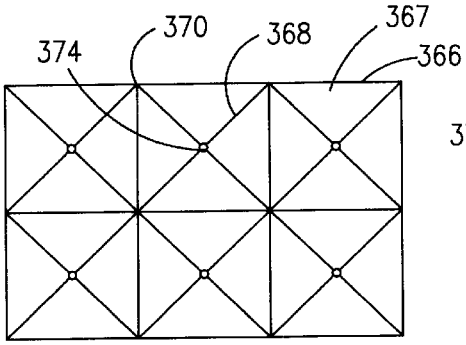
Figure 16:
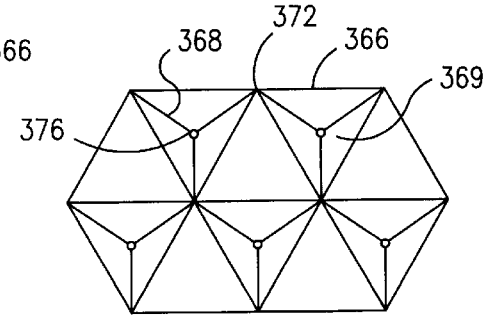
Figure 17:
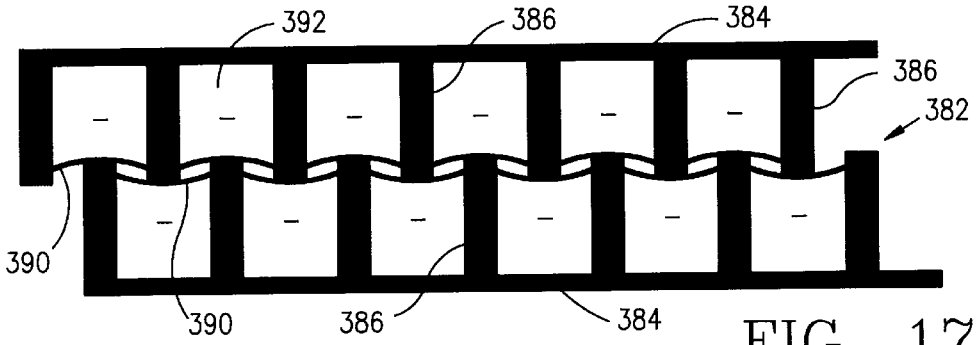
Figure 18:
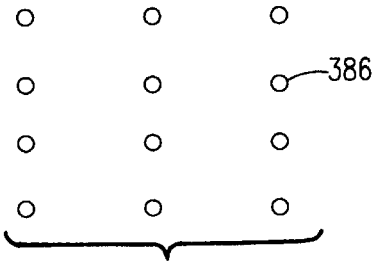
Figure 19:
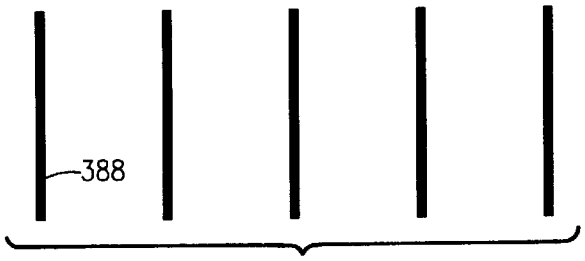

In the drawing,

FIG. 1*a* shows a chamber arrangement in longitudinal section,

FIG. 1*b* shows another embodiment of the chamber arrangement in longitudinal section, FIG. 2 shows another embodiment of the chamber arrangement in longitudinal section, FIG. 3 shows the chamber arrangement shown in FIG. 2 along the line 1—1, FIG. 4 shows a hall construction in longitudinal section, FIG. 5 shows an enlarged view of the hall roof structure as per FIG. 4, FIG. 6 shows a balloon construction based on a chamber arrangement in cross-section, FIG. 7 cross-section of an aerostat structure based on chamber arrangement, FIG. 8 a cross-section of a further roof structure, FIG. 9 top view of the roof structure according to FIG. 8, cutout, FIG. 10 section of a further design of a wall structure, cutout, FIG. 11 section of a further wall structure, cutout, FIG. 12 top view of a further roof structure, FIG. 13 a sectional drawing of the roof structure in FIG. 12, FIG. 14 a cutout of a wall or roof structure, FIG. 15 bottom and top view of a wall or ceiling structure, FIG. 16 a bottom and top view of a further wall or ceiling structure, FIG. 17 a longitudinal section of a further embodiment of a chamber arrangement, FIG. 18 an arrangement of wall elements corresponding to FIG. 17, FIG. 19 an arrangement of wall elements corresponding to FIG. 17, FIG. 20 a further embodiment of a roof structure and FIG. 21 a further embodiment of a wall structure.

FIG. 1*a* shows a vacuum/over-pressure chamber construction in which a combination of vacuum and over-pressure chambers provides a stable building element. As a result, heavy and heat-conducting support elements for the supporting framework can be very largely dispensed with in the roof construction.

A chamber arrangement (180) than can, for example, be used as a roof structure for a hall, receives first wall segments (181) that are of chamber-like design, hollow inside and arranged at a distance from one another. The wall segments (181) have an approximately rectangular cross-section. A slightly trapezoidal cross-section is preferably provided if a barrel-shaped curvature is to be created. Between each two wall segments (181), which extend over the entire wall thickness, second wall segments (182) are arranged that are of chamber like design and hollow inside. The second wall segments (182) begin like the first wall segments on the outside of the wall (180), and do not extend over the entire wall thickness, but only over part of it, with the remaining part of the intermediate space between each two wall segments (181) remaining free.

In the embodiment shown in FIG. 1*a,* the second wall segments each fill half of the intermediate spaces. The second wall segments (182) each have approximately rectangular or slightly trapezoidal cross-sections and are adapted like modules to the wall shape. The hollow areas of the wall segments (181), (182) are subjected to over-pressure and are connected to one another. As a result, they form a sturdy supporting structure. A gas-tight wall (183) is arranged between the wall inner ends of the first wall sections (181) and forms with the walls of the wall segment (181), (182) negative pressure chambers (184). The over pressure chambers and negative pressure chambers of the wall (180) are characterized in FIG. 1*a* by plus and minus signs. The wall segments (181), (182) can be connected to one another by openings, such that on the one hand simultaneous filling with compressed gas is achieved and on the other hand an even pressure. The negative pressure chambers (184) too can be interconnected by openings, such that in these chambers too an even negative pressure or vacuum can prevail thanks to simultaneous evacuation.

FIG. 1*b* shows a chamber arrangement (185) having two identically designed halves, i.e. an outer half (186) and an inner half (187). Each half (186), (187) contains first wall segments (189) arranged at a distance from one another and hollow inside, having approximately rectangular or trapezoidal cross-sections and being subjected to over-pressure. Between the first wall segments (189) are second wall segments (191) that are likewise hollow on the inside, have approximately rectangular or trapezoidal cross-sections and are subjected to over-pressure. The wall segments (191) start like the wall segments (181) at the outside of the wall and do not run like the first wall segments (189) over half the wall thickness, but only over part of the wall. A gas-tight film (193) is in contact with those ends of the first wall segments (189) in the middle of the wall. The intermediate spaces not filled by the second wall segments (191) between the first wall segments (189) are subjected to negative pressure, so that the film (193) is pressed against the wall segments (189). In the same way, a gas-tight film (195) is pressed against the first wall segments of the inner half (187), which is identically designed to the outer half (187).

The wall segments (189), (191) of the two halves (186), (187) are offset to one another by half the spacing of two wall segments (189). For that reason, those ends of the wall segments (189) arranged in the middle of the wall are in contact with the film of the opposite half. The wall segments (189), (191) are firmly interconnected. By the offsetting of the two halves (186), (187), the areas subjected to negative pressure of the two halves (186), (187) are adjacent to one another. The wall segments (189) of the two halves (186), (187) are only connected to one another by the films (193), (195), which are poor heat conductors.

The chamber arrangement shown in FIG. 1*b* has especially good heat insulating properties.

The wall segments (189), (191) can be connected in one half each by openings, not shown, such that in all chambers the same over-pressure can be generated at the same time. With regard to the negative pressure or vacuum, this shall also apply for the negative pressure chambers enclosed by the wall segments (189), (191) and by the films (193) or (195).

In FIG. 1*b,* plus signs are entered in the over-pressure chambers to indicate the over-pressure and minus signs in the negative pressure chambers to indicate the negative pressure. The device in accordance with FIG. 1*b* is suitable as a roof structure for a hall, with the wall segments being adjusted in modular form to the shape of the curvature. The wall materials of the wall segments (191), (189) and the films (193), (195) can be light-permeable.

FIGS. 2 and 3 show chamber arrangements each having two plates (188), (190) from the insides of which studs or beads (192) project at regular intervals. The beads (192) of the two plates (188), (190) are offset in relation to one another. Above the beads (192) is stretched a network of taut and if possible non-elastic cords or ropes (194) having a low heat conductivity. In the hollow area (196) between the plates (188), (190), a negative pressure or vacuum is generated, as a result of which the beads (192) press against the ropes (194) that absorb the force exerted by the air pressure on the plates (188), (190), i.e. the topes (192) made of plastic keep the two plates (188), (190) apart. The device shown in FIGS. 2 and 3 therefore acts, as regards the ropes (194), in the same way as a suspension bridge design.

FIG. 4 shows a hall structure (200) substantially comprising a hall floor (202) over which extends an arched hall roof structure (204), a rear wall (206) and a front wall, not shown. The hall roof structure (204) substantially comprises an inner skin (210) facing an inner area (208) and an outer skin (212). Supporting segments (214) of chamber-like design, hollow inside and spaced from one another, extend between the inner skin (210) and the outer skin (212). The supporting segments (214) have an approximately rectangular cross-section. A transparent film can be used as the construction material for the hall roof structure. The axial extend of the supporting segments (214) approximately corresponds to the axial extent of the hall roof structure (204). The supporting segments (214) are designed such that they can be filled with gas, e.g. helium. The supporting segment chambers (214) are preferably interconnected, such that a joint gas filling can take place. The supporting segments (214) receive their stability from the gas pressure. The pressure in the interior (208) is increased during operation of the hall structure (200) compared with the surroundings. As a result, outwardly directed forces act in particular on the inner skin (210), such that the hall roof structure (204) is inflated. Parallel to this, an increasingly stronger vacuum is generated in the chambers (216) between the supporting elements (214). The vacuum chambers too are connected, such that they can be jointly evacuated. Both the pressure in the interior (208) and the vacuum generated in the chambers (216) exert considerable forces on the hall roof structure (204). The hall floor (202) is designed such that it has maximum strength with minimum weight. It can have the chamber arrangement (180), which is then appropriately stabilized with a lattice construction, for example of carbon fiber.

FIG. 5 shows an enlarged section of the hall roof structure (204) which indicates clearly that the tensile forces occurring due to internal pressure balance the forces occurring inside the chamber due to the vacuum.

In practice, the heavy insulation of the hall roof structure (204) as result of the vacuum chamber (216) can cause the trapped air quantity in the interior (208) to heat up so much with a reduced air exchange that the hall structure (200) is subjected to a lifting force on the same principle as a hot-air balloon. This makes it feasible for larger hall structures too to be transported by, for example, load-carrying helicopters or airships.

FIG. 6 is a diagram of a gas vacuum balloon (217) in cross-section. Supporting elements (220) radiate out from a central chamber (218) such that their ends (222) would be in contact with a fictive globe surface. The ends (222) can also be aligned on other fictive spatial surfaces such as an ellipse or disc shape. The radiating arrangement of the supporting elements (220) is surrounded by a preferably transparent balloon skin (224) enclosing a balloon interior area (225). Between the ends (222) of the supporting elements (220) and the balloon skin (224), holding devices (226) are provided for attaching the balloon skin (224) to the ends. The supporting segments (220) are of chamber-like design, hollow inside and have preferably a truncated form with its smaller diameter in the direction of the central chamber (218). The supporting segments (220) preferably have a skin (228) comprising a high-strength, heat-absorbing and heat-resistant film.

In practice, the central chamber (218) and the supporting segments (220) are filled with a gas such as helium. The gas pressure lends the chamber structure high strength. The supporting segments (220) are interconnected with the central chamber (218) via holes (230), permitting gas exchange to take place. The central inner chamber (218) and the supporting segments can additionally have means (not shown) for circulating the gas, thereby enabling a continuous gas exchange between the segments (220) and the chamber (218).

The balloon skin (224) has a hole (234) into which is inserted a valve (236) connected to a vacuum pump (238), thereby permitting generation of a vacuum in the balloon interior (225).

It is also possible to let air flow into the interior of the balloon (225) via the valve (236) or another valve (not shown).

Furthermore, the balloon (217) has in its central chamber (218) an evaporator (242) connected via a pipeline (244) to an energy converter unit (246). The energy converter unit (246) is designed such that it can convert heat energy in the form of steam into electrical energy. The energy converter unit (246) is further connected by another pipeline (248) back to the evaporator (242). A pressure tank (250) is preferably arranged along the pipeline (244) and can be used to store energy. The pressure tank (250) can also be arranged inside the evacuated balloon skin (224), so that the latter is optimally heat-insulated in relation to the surroundings. The pressure tank can be used for energy storage. A water boiler (252) is arranged along the pipeline (248) and can be used to store water. The water boiler (252) can also be arranged inside the evacuated balloon skin (224).

When operating the gas vacuum balloon, the gas, such as helium, which is inside the supporting segments (220) is gradually strongly heated by sunlight. The vacuum surrounding the supporting segments (220) make these segments almost ideally insulated against their surroundings, so that there is no heat dissipation to the outside. The heat energy from sunlight can therefore be convened almost completely into internal energy of the gas. If the gas such as helium attains a temperature of, for example, more than 100° C., water flowing in can be converted by the evaporator (242) into steam. The steam is passed via the pipeline (242) to the energy converter unit (246), where the heat energy is converted into electrical energy. A condenser located in the energy converter unit (246) converts the remaining steam back into water and passes it back to the evaporator (242) via the pipeline (248). The vacuum pump can be operated with the electrical energy generated.

As already mentioned further above, the gas pressure inside the supporting segments (220) rises due to heat irradiation, so that the chamber structure comprising the supporting segments attains a greater strength. This provides the possibility of generating a stronger vacuum in the balloon interior, in turn improving the insulation. With this arrangement, it is possible to generate a strong lift with small quantities of gas, such as helium, with this lift being precisely controllable by variation of the vacuum. The surrounding air can in this case serve as an alternative ballast.

FIG. 7 shows the design of a gas/vacuum airship (255) in a diagrammatic cross-section. The arrangement comprises substantially a circular-ring-shaped supporting segment (256), in the center (257) of which is located a further arrangement of supporting segments (258). The supporting segment arrangement (258) has a spherical chamber (262) with which two supporting segments (263, 264) parallel to the supporting segment (256) and also circular-ring-shaped are in contact. The arrangement of supporting segments (256) and (258) is enclosed by a skin (266). The outer form of the skin (266) thus corresponds to the form of a disk. As in the arrangement of the balloon (217) described above, here too the supporting segments are filled with a gas such as helium. The supporting segments obtain their stability from the gas pressure. An inner area (268) enclosed by the skin (266) can also be evacuated as in the case of the balloon (217). The airship furthermore has a cabin (270) connected to the skin (266). A drive unit (272) is attached to the cabin. As with the balloon (217), exact attitude control of the airship (254) too is possible in this design by varying the vacuum.

The drive unit (272) can also be powered by solar energy. The skin (266) and the supporting segments (256), (260), (262) and (264) are advantageously also made from a lightweight film material, so that the skin (266) or the supporting segments can be folded up at short notice. It should be noted that the balloon arrangement (217) too can be provided with a cabin (270) and hence used as an airship. The outer shape and size can be selected to suit the load to be transported.

Further embodiments of the invention's vacuum and pressure chamber structures to build roofs and walls of constructions can be found in FIG. 8.

In FIG. 8 cutout shows a roof structure 300 consisting of inflatable first wall elements 302 and second wall elements 304. The first and second wall elements 302 and 304 feature a tubular design in the sample embodiment and are characterized by a circular cross-section. Of course the wall elements 302 and 304 can also take on other geometrical features and another cross-sectional shape, rectangular for instance.

The interior side of the inner wall elements 304 running the length of the roof 300 is covered with a sheet 306. The sheet 306 is tightly sealed to the second wall element 304 and preferably bonded and welded to it.

The exterior wall elements 302, positioned vertically to the longitudinal axis of the roof structure 300 are covered themselves with a sheet 308, whereby sheet 308 is also sealed to the first wall elements 302 and also preferably bonded by means of welding.

As a result the sheets 306 and 308 border a chamber 310 between the first and second wall elements 302 and 304, said chamber 310 being a vacuum chamber. This results in a roof structure 300 which reflects the teaching according to the invention. The vacuum in chamber 310 can give the roof a barrel-shaped arch without any further supports, whereby the shape can be determined by the low pressure in chamber 310.

Although in the embodiment example one continuous vacuum chamber 310 is included, this chamber can also be divided into sections. There is also the option of connecting the first and second elements 302, 304 with each other so that equal pressures prevail in wall elements 302, 304. Of course it is also possible to develop either the first or the second wall elements as closed bodies. The only essential point is that between the first and second wall elements chambers are formed which can withstand reduced pressure.

A roof structure found in FIGS. 8 and 9 can now be supported by wall elements as can be seen in a purely exemplary embodiment contained in FIGS. 10 and 11.

According to FIG. 10 the structure 310 consists of two identically structured halves 312 314 which in turn consist of first and second wall elements 316 and 318. The first wall elements 316 are mutually spaced. The second wall element 318 is situated between the first wall elements 316, whereby, in the embodiment exemplified, the elements are joined at their centers. Of course a structure corresponding to FIG. 1*b* can also be selected.

The first wall elements 316 are vertical to the surface held by the wall, whereas the second wall elements 318 are positioned parallel to this surface.

Along the outer sides 320, 322 of the first wall elements 316 one sheet 324, 326 each is spread to be available for the reduced-pressure chambers 377. This results in a structure of the above described type. The second half 314 of the wall structure 310 is formed in a manner corresponding to the half 312, but in this case the first wall elements of the second half 314 are positioned staggered in relation to the first wall elements 316 of the other part 312. In this matter parallels can also be seen relative to the structure according to FIG. 1*b*.

The wall structure 326 according to FIG. 11 deviates form the wall structure 310 according to FIG. 10 by the fact that the former is not divided into two halves. Thus only the first wall elements 378, mutually spaced and arranged vertically to the level held by wall structure 326, whereby second wall elements 330 extending between the first wall elements 322 and parallel to the level held by the wall structure 326. Along the outer sides 332, 334 of the first wall elements 328 sheets 366, 338 are located which are sealed to the first wall elements 328, and in this manner provide a potential continuous chamber 340, to which a partial vacuum can be applied. As in FIGS. 8 and 9, the first pressurized wall elements 316, 328 shown in FIGS. 10 and 11 are also marked with a plus sign and the vacuum chambers 327 and 340 with a minus sign.

FIGS. 10 and 11 further imply that on the outside, along the first wall elements 316 or 328 coverings 342, 344 can be located, especially in order to prevent any damage to the chambers 327, 314 or to the first and second wall elements 316, 318, 328, 330. The coverings 342, 344 should in addition provide additional stability to the wall structure 310, 326. The coverings 342, 344 can consist, for example of sheet metal material.

The wall structures 310, 326 found in FIGS. 10 and 11 can also be used in a roof structure as can be seen from FIGS. 12 and 13. As the top view in FIG. 12 shows, the corresponding structure 346 is circular and consists of wall elements 348, 350, being concentric in relation to the center of the roof structure, tubular in shape and—as the sectional drawing contained in FIG. 13 shows—featuring a rectangular geometry. Of course a different cross-section can be selected. Second tubular type wall elements 352, 354, 356 are located along the inner side and positioned like spokes. The first and second tubular wall elements 348, 350, 352, 354, 356 are—as the plus sign indicates—pressurized. On the outer side the first wall elements 348, 350 are covered tightly with a first sheet 358 and on the inner side the second wall elements 352, 354, 356 are covered tightly with a second sheet 360 and bonded so that a vacuum chamber 362, is the result. This results in a roof structure 346 corresponding to the teaching stated above.

The roof as well as the wall structure featuring the chamber arrangement in accordance with the teaching integral to the invention can feature a structure, as can be found in FIGS. 14–19, by means of which additional designs of the invention will be elucidated. Thus, in FIG. 14*a* purely exemplary section of a roof or wall structure 364 is shown which consists of first tubular type, pressurized wall elements 366, 368. The first and second wall elements 366, 368 run along the edges of a pyramid whose base, for example, is a square 367 (FIG. 15) or a triangle 369 (FIG. 16). From the corners 370, 372 of the base 367 or 369 the second tubular type wall elements 368 extend outwards which are anchored to each other above the center of the base. The first and second wall elements 366, 368 form consequently a half-timber type framework. Along the base 367 or 369 and along the points formed by the connecting point 374, 376 of the second wall elements 368 sheets 380 are located, in order to form a closed chamber 382 can be evacuated. This results in a sturdy supporting structure 364.

From FIG. 14 can also be seen that two corresponding supporting structures, in a staggered position relative to each other whereby their apexes 374, 376 correspond to the orthocenters 374, 376 of the second wall elements 368, are facing each other. The basic idea in reference to the same design of the parts of the supporting structure 364 and its mutually staggered arrangement falls accordingly back on structural elements which are explained with the help of FIGS. 1*b* and *c*.

The supporting structure 382 found in FIG. 17 deviates from the one in FIG. 14 in the sense that second wall elements 386 start from the also tubular or strip-shaped, pressurized first wall elements 384, extending downwards vertically which corresponding to FIG. 18 are tubular or corresponding to FIG. 19 feature a lengthwise extension. The corresponding wall elements whose cross section has a rectangular shape in accordance with FIG. 19 are designated with the reference number 388.

Along the free ends of the second wall elements 386 a sheet 390 is stretched. Correspondingly a sheet has been planned outside along the first wall elements 384, if the first wall elements 384 do not produce a closed surface. Between sheets 390 and the first wall elements 384 a closed chamber 392 is located which itself can be divided by second wall elements 388. The chamber 392 can then be evacuated in order to achieve a supporting structure according to the invention. The supporting structure 382 can as specified in FIG. 14—consist of two identical parts; whereby the free ends of the second wall elements 386, along which the sheet 390 is stretched, face each other.

In FIGS. 20 and 21 further embodiment examples of a light-weight wall or roof structure for a construction present ought to be emphasized, whereby especially substantial heat insulation is guaranteed. The structure of the roof structure 394 contained in FIG. 20 corresponds to the wall structure 396 and 38 as shown in FIG. 21 so that for identical elements the same reference numbers are used.

The roof structure according to the invention consists of one inner half 400 and one outer half 402, identically constructed but in a staggered arrangement. Thus the inner half 400 consists of an inner wall element arrangement 404, whose surface extension corresponds to the roof structure itself. In the embodiment example the inner wall element arrangement 404 consists of lined-up inflated tubular bags made of sheeting. A different geometry or structure is also possible. Thus, the inner wall element arrangement 404 can also consist of pressure resistant synthetic foam material. Pointing outwards from the outer surface 406 of the inner wall element arrangement 404 projections 408 can also be inflatable, tubular bags made of sheeting. The projections 408 are staggered. On the outer side along the projections 408 a flexible element such as a sheet 410 is stretched which forms a seal with the projection 408. This forms a chamber which is bordered by sheet 410, the inner wall element arrangement 404 and the projections 408.

In the embodiment example the chamber consists of chamber segments 412, 414, each of which are located between two projects 408, a section of sheet 410 and a section of the wall element arrangement 404. The chamber 412, 414 can be evacuated. This is symbolized by the minus sign. The plus sign in the inner wall element arrangement 404 as well as in the projections 408 means that these chamber are either made of pressure-resistant synthetic foam material elements or gas inflatable bags.

Even though the chambers 412, 414 are preferably evacuated, the chambers 412, 414 can also be inflated with a gas of low thermal conductivity. As illustrated in the arrangement drawing in FIG. 20 the sheet 410 follows a wave pattern, i.e. in the area between the two projections 408 set back in the direction of the wall element arrangement 404.

The outer half 402 is built corresponding to the inner half 400 of the roof structure 394. Thus projections 418 extend from an external wall element arrangement 416, which can consist of tubular gas-inflated bags. The projects 418, which are tightly bonded to the outer wall element arrangement 416, can also be tubular and gas-inflated. A sheet 420 is positioned on the outside, along the projects 418, which contributes to the formation of chambers 422 between the wall element arrangement 416 and the projections 418, said chambers being evacuated and/or inflated with a gas characterized by poor thermal conductivity.

The wall structures 396, 398 are built corresponding to the arrangement of the roof structure 394. This means that every wall structure 396, 398 consists of one inner half 424, 426 and an outer half 428, 430 of one structure as exemplified in FIG. 20.

Instead of sheets 410, 420 other flexible, surface elements can be used which perform the identical function as a sheet.

What is claimed is:

1. A structure of light-weight design for construction of a wall and roof, said structure comprising:

an inner pressure-resistant first wall element arrangement having dimensions corresponding to the inner surface of the wall and roof, first projections, which are extending from the first wall element arrangement pointing outwards, a flexible first element extending along the outer ends of the projections, an outer, pressure-resistant second wall element arrangement having surface dimensions corresponding to the outer surface dimensions of the wall and roof, second projections pointing inwards starting from the second wall element arrangement, a flexible second element extending along the outer ends of the second projections, the first wall element arrangement together with the first projections and the first flexible element forming inner halves of the wall and roof, the second element wall arrangement with the second projections and the second flexible element forming outer halves of the wall and roof, the first projections of the inner halves being staggered relative to the second projections of the outer halves.

2. The structure according to claim 1, wherein the first projections are evenly distributed along the first wall element arrangement.

3. The structure according to claim 1, wherein the second projections are evenly distributed along the second wall element arrangement.

4. The structure according to claim 1, wherein the first wall element arrangement consists of inflatable bags.

5. The structure according to claim 1 wherein the second wall element arrangement consists of inflatable bags.

6. The structure according to claim 1, wherein at least one of said first and second wall element arrangement consists of synthetic foam material.

7. The structure according to claim 1, wherein the first flexible element, the first projections and the first wall element arrangement border a first chamber.

8. The structure according to claim 1, wherein the second flexible element, the second projections and the second wall element arrangement border a first chamber.

9. The structure according to claim 7, wherein the first chamber is a vacuum chamber.

10. The structure according to claim 7, wherein the second chamber is a vacuum chamber.

11. The structure according to claim 7, wherein the first chamber is inflated with a gas of low thermal conductivity.

12. The structure according to claim 8, wherein the second chamber is inflated with a gas of low thermal conductivity.

13. The structure according to claim 1, wherein at least one of said first and second flexible element is a sheet.

14. The structure according to claim 1, wherein at least one of said first and second flexible element in the area between the first and second projections is set back relative to the free ends.

15. The structure according to claim 1, wherein the first and second projections are arranged so that the second projections are positioned between the first projections.

* * * * *